US007926617B2

(12) United States Patent
Lockwood et al.

(10) Patent No.: US 7,926,617 B2
(45) Date of Patent: Apr. 19, 2011

(54) QUICK OIL CHANGE APPARATUS AND PROCESS

(75) Inventors: Frances E. Lockwood, Georgetown, KY (US); Timothy Lee Caudill, Catlettsburg, KY (US); Joseph Huang, Lexington, KY (US)

(73) Assignee: Ashland Licensing and Intellectual Property LLC, Dublin, OH (US)

( * ) Notice: Subject to any disclaimer, the term of this patent is extended or adjusted under 35 U.S.C. 154(b) by 0 days.

(21) Appl. No.: 12/466,807

(22) Filed: May 15, 2009

(65) Prior Publication Data

US 2009/0283363 A1 Nov. 19, 2009

Related U.S. Application Data

(63) Continuation of application No. 10/984,028, filed on Nov. 8, 2004, now abandoned.

(60) Provisional application No. 60/518,564, filed on Nov. 7, 2003.

(51) Int. Cl.

| | |
|---|---|
| ***F16C 3/14*** | (2006.01) |
| ***F16N 33/00*** | (2006.01) |
| ***F01M 1/02*** | (2006.01) |
| ***F01M 11/04*** | (2006.01) |

(52) U.S. Cl. ..... 184/1.5; 123/196 R

(58) Field of Classification Search ..... 184/1.5; 123/196 R, 196 A

See application file for complete search history.

(56) References Cited

U.S. PATENT DOCUMENTS

| | | | | |
|---|---|---|---|---|
| 195,126 | A * | 9/1877 | Hersey | 222/389 |
| 2,594,779 | A * | 4/1952 | Huffman | 184/1.5 |
| 5,044,334 | A * | 9/1991 | Bedi | 123/196 R |
| 5,074,379 | A * | 12/1991 | Batrice | 184/1.5 |
| 5,522,474 | A | 6/1996 | Burman | |
| 5,871,068 | A | 2/1999 | Selby | |
| 6,019,196 | A * | 2/2000 | Selby et al. | 184/1.5 |
| 6,098,752 | A * | 8/2000 | McCaleb | 184/1.5 |
| 6,374,872 | B1 * | 4/2002 | Tarabocchia | 141/98 |
| 6,435,307 | B2 * | 8/2002 | Selby | 184/1.5 |

* cited by examiner

*Primary Examiner* — Michael R Mansen
*Assistant Examiner* — Robert T Reese
(74) *Attorney, Agent, or Firm* — Wood, Herron & Evans, L.L.P.

(57) ABSTRACT

A method and apparatus for changing engine motor oil more quickly and simply than previously existing methods. To change oil on a gasoline or diesel engine, the conventional oil filter is removed and an adapter is screwed in its place. An inlet oil port of the adapter connects with the oil filter inlet line and an outlet port of the adapter connects to the oil filter outlet line. The adapter top is sealed with a recessed O-ring extending around the periphery so that oil can be pumped through the adapter into and out of the engine without leaking. The adapter inlet and outlet ports are connected by hoses/tubes to an external container with its own internal piston. The engine is turned on to idle and the engine oil pump pumps used oil from the oil pan out through the adapter outlet port into the external container. An external feed pump or valve can be used with an accumulator to temporarily hold a portion of the new oil pushed out of the piston/cylinder reducing the initial oil flow back into the engine providing enough oil flow and pressure to maintain adequate lubrication and reduce the dilution of new oil with used oil maximizing the quality of the replacement oil and minimizing the amount of new oil required in the displacement process.

10 Claims, 5 Drawing Sheets

Internal Piston

Crushable Bag

QUICK OIL CHANGE APPARATUS AND PROCESS

This application claims priority to U.S. Utility application Ser. No. 10/984,028 filed Nov. 8, 2004 that claims priority from U.S. Provisional Application Ser. No. 60/518,564 filed On Nov. 7, 2003 both of which are hereby incorporated by reference herein.

BACKGROUND OF THE INVENTION

1. Technical Field

An oil change apparatus for changing engine oil in a internal combustion engine having an oil circulation system, oil filter, sump pump and oil pump, whereby the oil change can take place under the hood without requiring removal of the drain plug by substituting an adapter in place of the oil filter to remove the used engine oil and replace same with fresh engine oil using the internal combustion engine oil pump and a container having a compressible member whereby the weight and force of the used engine oil entering the container forces new fresh engine oil into the engine.

2. Description of the Prior Art

Current practice is to drain oil manually from the engine pan by removing the drain plug and waiting for the engine oil to drain from the oil pan. Draining the oil from a diesel engine by gravity typically takes around ten minutes or more by this method.

There is prior art for various other oil drain schemes through the dip stick or through the drain plug. Current practice is to drain oil manually from the engine pan by removing the drain plug, Drain from a diesel engine takes approximately 16 minutes, as tested on a cold ISB engine, or more. There is prior art for various other methods for draining engine oil such as through the dip stick or through the drain plug. Some methods require physical and permanent modifications to the engine block itself. Some of these are assisted by a machine with an external oil pump. Patents considered pertinent to the patentability of the instant invention are listed below.

U.S. Pat. No. 6,374,797, by Fischer teaches the use of an insert unit to be inserted into the oil reservoir so that oil change can be accomplished by removal and insertion of the insert. U.S. Pat. No. 5,640,936 by Hudson teaches the use of a removable oil tank and oil filter, for dry marine sumps. U.S. Pat. No. 5,130,014 by Volz teaches the use of a removable sump pan. U.S. Pat. No. 6,508,280 by Capstran teaches an combined oil drain and fill apparatus including a drain waste container, and supply and waste pumps whereby oil is removed by inserting a hose through the oil fill cap into the bottom of the sump. U.S. Pat. Nos. 5,318,080 and 5,472,064 by Viken teach a method of draining automatic transmission fluid. U.S. Patent Publication Serial No. US 2003/0037993 and corresponding Canadian application Serial No. 2399389 by Hatch teach a method for continuously replacing engine oil with an oil replacement cylinder whereby the new oil enters the engine at the same rate that the old oil exits the engine.

Perma Industries, INC, Ontario CA 91761, p# 909-390-1550 f# 909-390-1551 manufactures various engine oil and transmission fluid accessories for a vehicle, such as external oil coolers, including an oil filter adapter. U.S. Pat. No. 5,964,256 by Ram D. Bedi of K.J. Manufacturing teaches a oil filter adapter permanently attached with the draining of the used oil via a drain plug adapter.

SUMMARY OF THE INVENTION

In the present invention an adapter is used to replace the engine oil filter. The adapter contains an inlet and an outlet port. The bottom of adaptor is threaded to replace the oil filter. Adapters are made to fit each engine type, similar to current practice for oil filters. Such adapters are currently available on the market and are used for remote oil filters or coolers. The adapter is essentially the shape of an oil filter with the oil flow control of an oil filter except without the filtering material. It therefore can also be considerably more compact than an oil filter, although its size can vary as long as it fits in the engine compartment in place of the oil filter. A hose/tube is connected to both the adapter outlet port and adapter inlet port that is connected to an external oil container with an internal piston. When the engine is operating at idle, the engine oil pump pumps used oil from the sump of the oil pan up to the oil filter outlet through the adapter outlet port and into a used oil section of the external oil container. The used oil pushes on an internal piston of the external oil container and forces new oil on the other side of the container into the inlet hose going to the adapter inlet oil port and into the engine. Thus oil can be changed easily and quickly from underneath the hood without accessing the oil drain plug which is usually accessed by crawling under the vehicle or suspending the vehicle on a lift.

It is contemplated that a means of compression can comprise a piston or even a diaphragm. Addition of an accumulator enables the user to control the amount of oil being pumped into the engine with a valve arrangement or external pump in order to remove and replace the used oil with the new oil and minimize mixing which aids in maintaining the quality of the new oil minimizing dilution with residual used oil and reduces the amount of new oil needed in the replacement process.

The apparatus and method of changing oil in accordance with the present invention enabled provided means to reduce the oil change (drain and replacement) time from sixteen minutes using the conventional gravity drain method to three minutes for a Cummins ISB (cold) engine.

Catastrophic mistakes can lead to starvation of the engine of lubricating oil for extended periods of time. Safe features can be implemented to minimize both the occurrence and damage of such mistakes, such as oil bypass, sensors, and alarms.

It is an object of the present invention to change oil more quickly than by traditional methods gravity drain methods utilizing the engine oil pump and without requiring one or more additional pumps.

It is an object of the present invention to change oil very quickly without having to access to the drain plug.

It is an object of the present invention to reduce environmental concerns from spillage.

It is an object of the present invention to reduce the amount of used oil which is retained in the engine and mixes with the new oil by delaying the displacement of the new oil with a timer to control the activation of the piston in the external oil container.

It is an object of the present invention to utilize an accumulator in order that the used oil can be collected at a faster rate than the new oil replacing same.

It is another object of the present invention to utilize an external pump or valve arrangement to control the flow rate of the used oil and/or new oil.

It is an object of the present invention to have the ability control the flow rate of the used oil flowing through the adapter outlet port and/or the adapter inlet port.

It is another object of the present invention to reduce oil change times.

It is an object of the present invention to provide an adapter which can be used on all types of engines with an externally exposed oil filter.

It is an object of the present invention to provide an adapter and quick method of changing oil whereby any fluid can be exchanged with this system.

It is an object of the present invention to provide a fluid exchange system can be made portable, or installed in a mobile shop/vehicle, to allow easy field operation.

It is an object of the present invention to provide as an option a bag comprising a crushable internal bag containing the new oil whereby an external part of the bag will connect to the used oil line from the adapter outlet port, and the internal portion of the bag will be sealed from the external part of the bag and will have a connection to the new oil part of the adapter. The bag can be prefilled with the proper amount of engine oil for a particular vehicle. A consumer could buy the bag with a reusable adapter and never have to change oil from under the vehicle. The bag would be made from a plastic that withstand the temperature of hot oil from and engine and withstand oil line pressures.

The foregoing and other objects and advantages of the invention will be set forth in or apparent from the following description.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

The present invention is a quick oil change apparatus which provides the user with the means to change oil without having to remove the oil pan drain plug by utilization of an adapter to replace the engine oil filter with connections to a supply of fresh motor oil and a container for the used motor oil. The engine oil sump pump provides the means for circulating the oil removing the used oil and replacing it with new fresh oil.

A typical diesel engine has an oil filter assembly whereby the filter is a spin type filter having a face including a central threaded bore for threadably engaging a threaded pipe extending from the engine filter attachment comprising a cap having a groove and O-ring extending around the outer periphery forming a seal therebetween.

Figure 7:
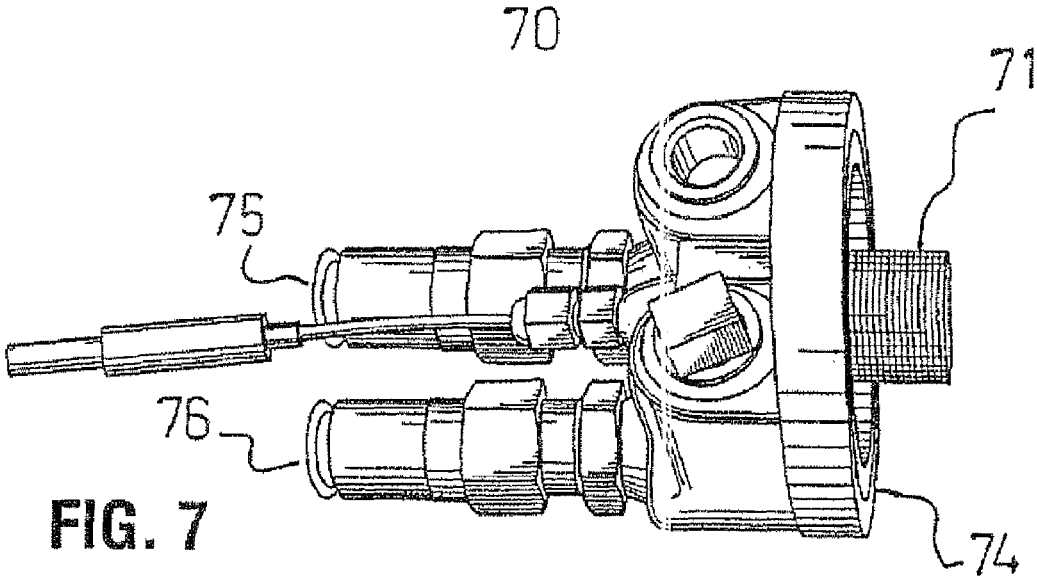
FIG. 7 is a perspective top view of a quick oil change apparatus adapter showing the adapter cap including a threaded coupling disposed therein and quick disconnect couplings for the inlet and outlet ports.
Figure 8:
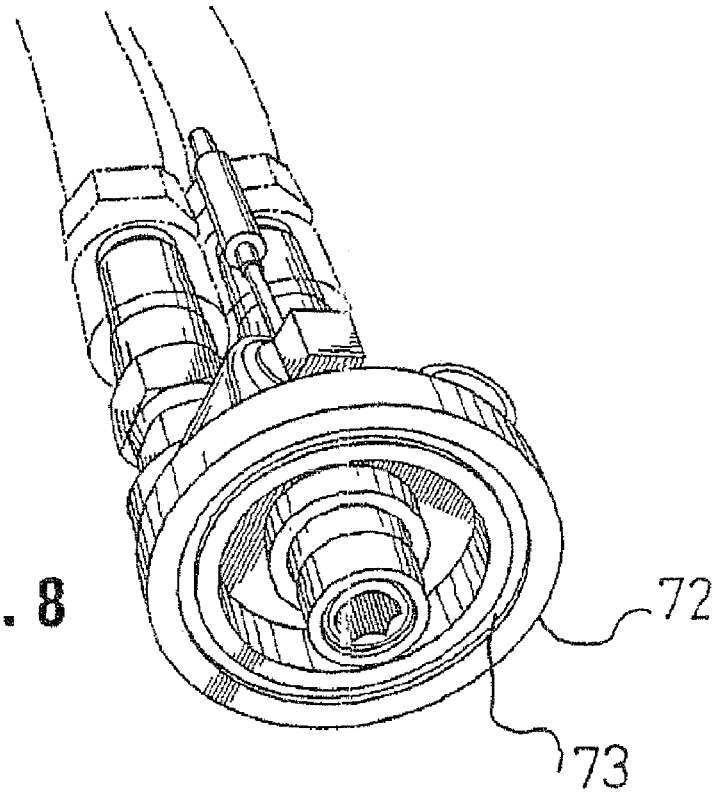
FIG. 8 is a perspective view of the quick oil change apparatus adapter of FIG. 7 showing the face of the adapter cap, the flange, and the groove extending around the lip of the cap for receiving an O-ring.
Figure 9:
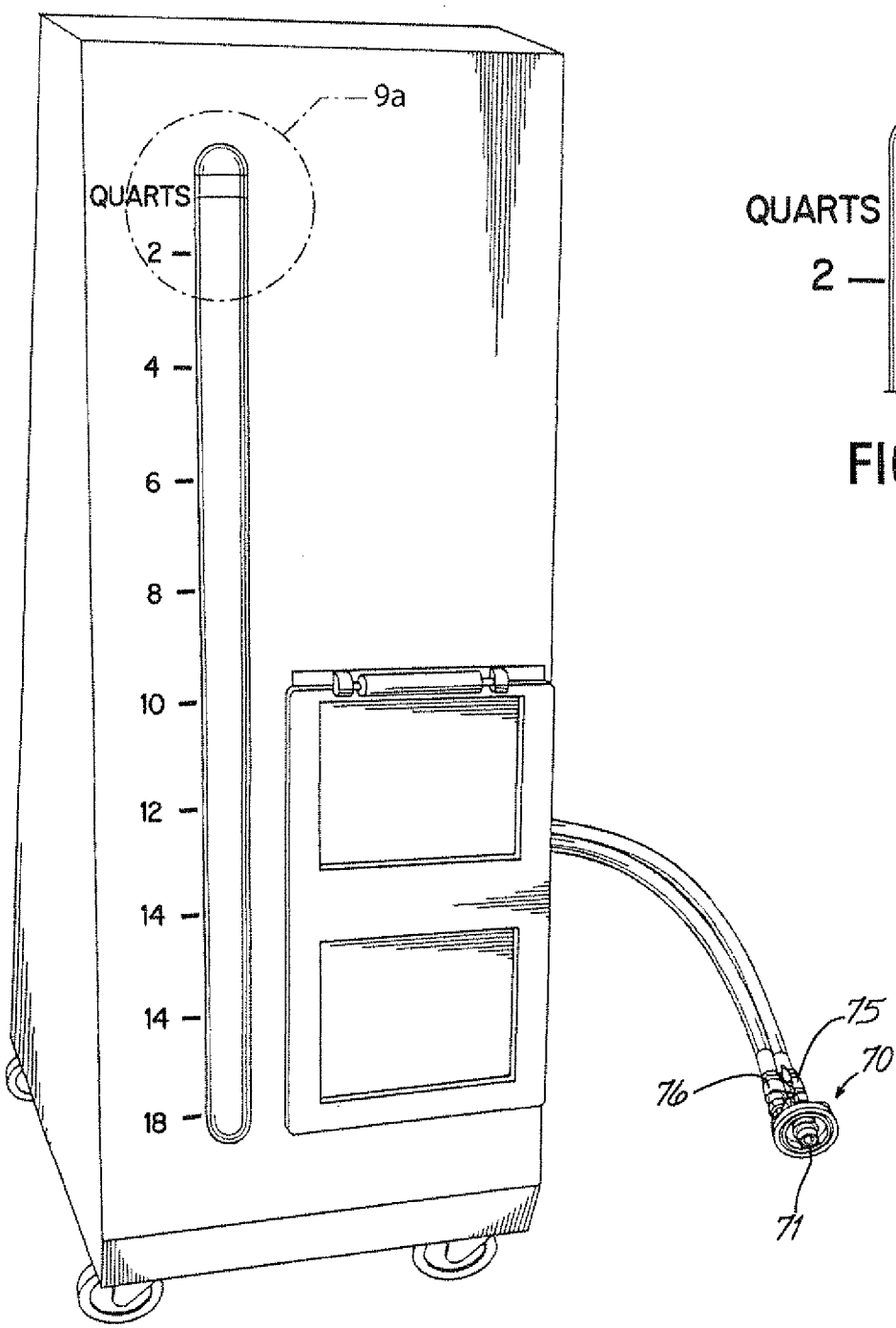
FIG. 9 is a perspective view showing the reservoir apparatus of FIG. 3 with a sight glass indicator showing the amount of oil remaining in the reservoir after the piston has moved in response to the engine pumping used oil into the reservoir.
Figure 9A:
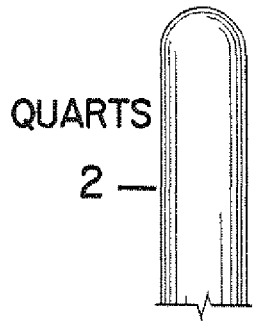
FIG. 9*a* is a perspective view showing an enlargement of the upper portion of the sight glass of FIG. 9.

As best shown in the drawings in FIGS. 7 and 8, the quick oil change apparatus includes an adapter 70 comprising a generally cylindrical disc forming a cap having peripheral sidewalls forming a lip 72 therearound and a centrally located flange extending downwardly from the bottom surface of the cap and having a threaded interior surface 71 for cooperative engagement with the tube/pipe or nipple having a threaded exterior surface which extends from the engine block typically used for threadably engaging a spin on oil filter. The lip of the adapter includes a groove 73 extending therearound. An O-ring having a thickness of slightly less than the width of the groove is disposed within the groove. The depth of the groove is less than that of the O-ring so that when the adapter is threadably received onto the threaded engine block oil filter attachment tube and tightened the O-ring will be compressed against the face of the engine oil filter attachment surface and the groove thereby forming a liquid tight seal between the engine and the lip extending around the bottom surface of the adapter cap and a liquid seal is formed between the threaded engine oil filter attachment tube and the opening thought the threaded flange in the adapter cap. An inlet port 75 and an outlet port 76 extend from a top surface of the adapter cap having openings there through. Each port comprises a threaded coupling extending therefrom. The preferred embodiment includes quick attachment couplings typically known as "HANSON fittings" for cooperatively engaging mated coupling extending from the distal end of a pipe, tube, or hose.

Thus, the adapter 70 in FIG. 7 is used to replace the engine oil filter. Oil from the engine enters the adapter outlet port 76 then to an external device/reservoir. From the external device/reservoir, oil enters the adapter inlet port 75 and then back into the engine. The flange end 74 of the adapter is essentially the shape of the flange end of an oil filter. The adapter 70 utilizes similar oil flow control as an oil filter except without the filtering material.

Adapters for the instant invention are made to fit a variety of engines sized in accordance with the oil filters used therewith.

Figure 3:
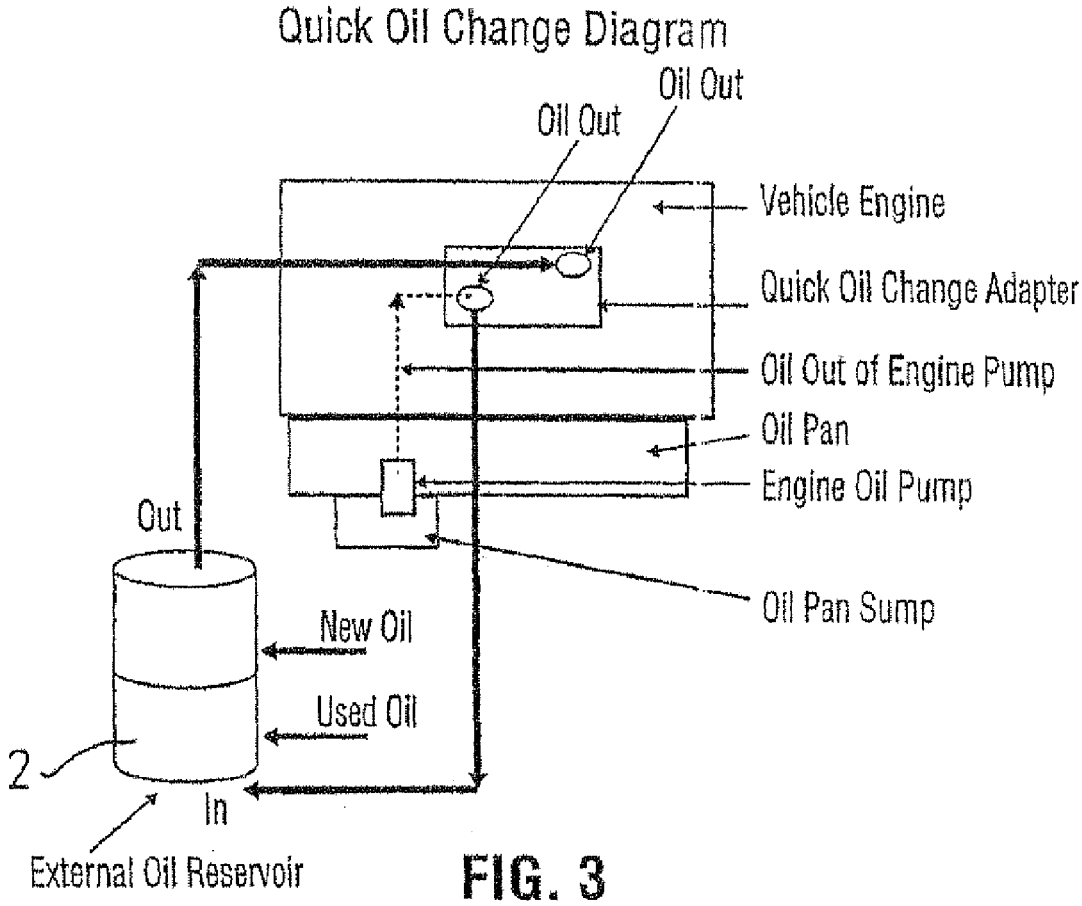
FIG. 3 is a schematic showing the flow path of the used oil from the engine to the reservoir and the new oil from the reservoir to the engine.
Figure 4:
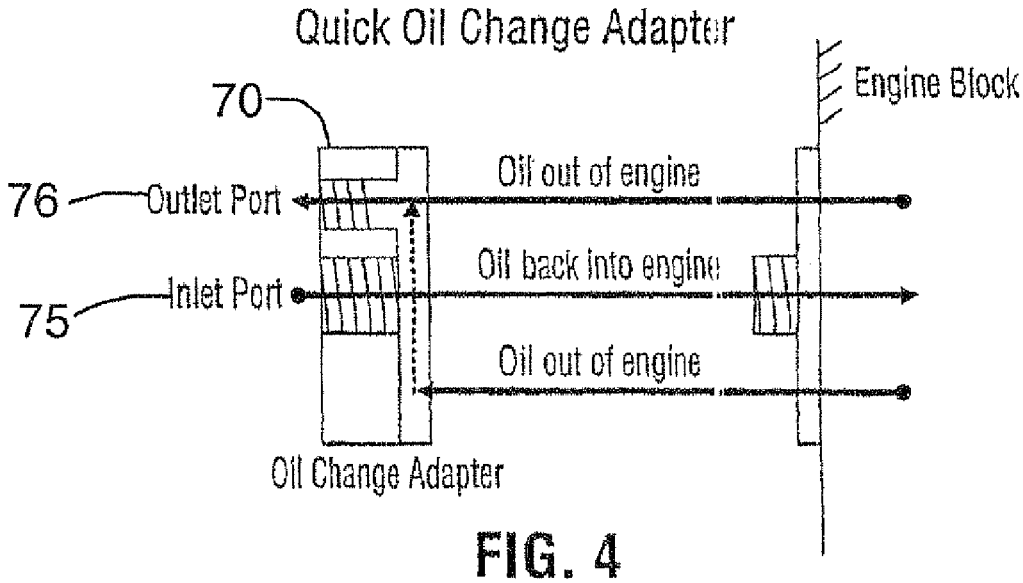
FIG. 4 is a schematic showing the flow path of the used oil from the engine to the reservoir and the new oil from the reservoir to the engine.

The method of use of the adapter for the instant invention is as follows:

As illustrated in FIG. 3, the used motor oil from the engine is pumped from the adapter outlet port and then to an external device/reservoir. From the external device/reservoir, new oil enters the adapter inlet port, and then back into the engine. Hoses/tubes or other conduit means are connected to both adapter outlet and inlet ports that run to an external device/reservoir. The primary functionality of the device/reservoir is to hold the used oil and dispense fresh oil so that at the end of the oil change, the amount of fresh oil introduced is equal to the amount of used oil removed.

Figure 1:
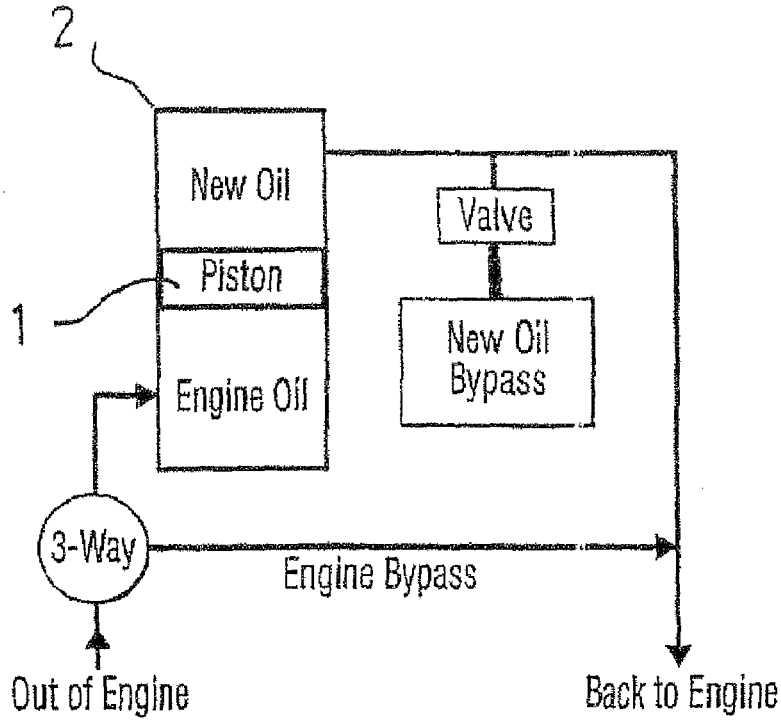
FIG. 1 is a schematic showing a piping and reservoir system wherein used oil is forced out of the engine into a reservoir and against a piston which, in turn, forces new oil back into the engine.
Figures 5A, 5B, 5C:
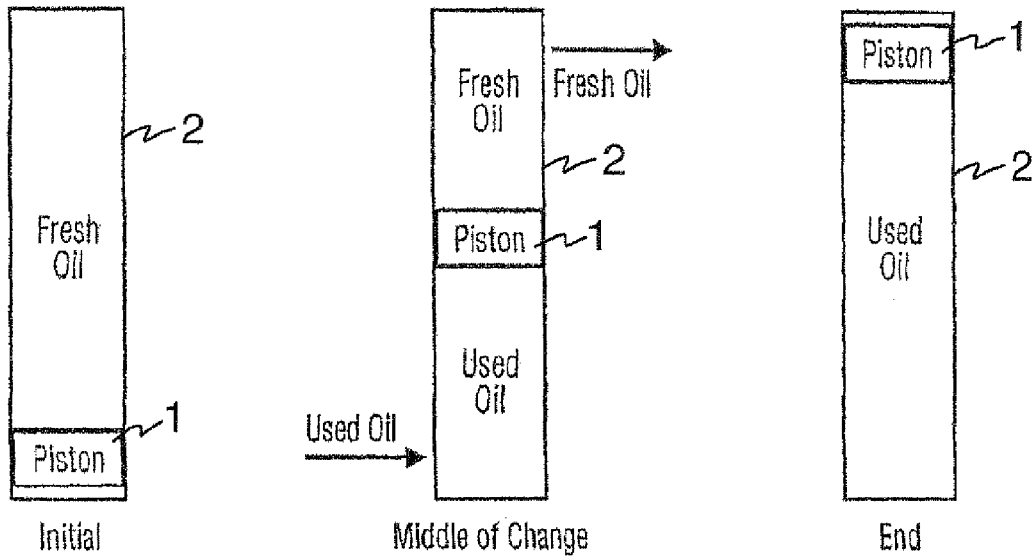
FIGS. 5*a*, 5*b*, and 5*c* are schematics showing the stages of movement of the internal piston of the reservoir device during the oil change process.

FIGS. 1 and 5 show a reservoir device 2 utilizing an internal piston 1 comprises a cylindrical chamber divided into two regions by a mobile piston 1. Initially, the piston 1 is bottomed out such that fresh oil is on top and the used oil region is empty. When the engine is running, used oil is pumped into the used oil region of the chamber. Since oil is an incompressible liquid, this action forces the piston upwards, thus displacing fresh oil out of the fresh oil region. In one preferred embodiment, the reservoir device is a T-TECH® Automatic Transmission Flush device which is essentially an "internal piston." Their device is listed as being used for transmissions service only. The patents listed on their devices are U.S. Pat. Nos. 5,318,080; 5,472,064; DES 365,583 and RE 36,650. A suitable internal piston device for use for the present invention is manufactured by Century MFG CO, 9231 Penn Ave. So., Bloomington, Minn. 55431. It is believed that the company has been acquired by Clore Automotive, 8735 Rosehill Road, Suite 220, Lenexa, Kans. 66224, p#800-328-2921 f#913-310-1075.

Figures 6A, 6B, 6C:
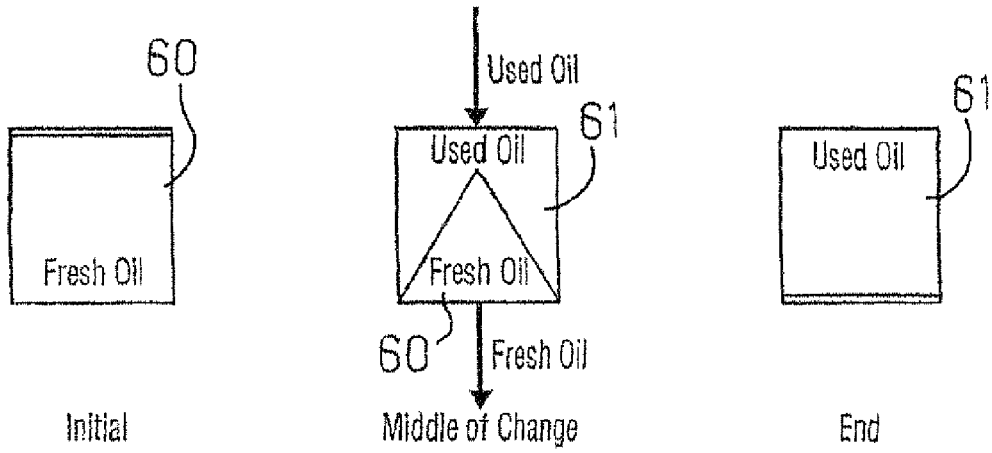
FIGS. 6*a*, 6*b*, and 6*c* are schematics showing stages of a reservoir apparatus using a crushable bag to contain the oil.

In another preferred embodiment a crushable bag 60 is used to contain fresh motor oil as shown in FIG. 6. A container 61 is initially lined with a bag 60 containing fresh oil. When the engine is running, used oil is pumped into the space between the bag 60 and container 61, thus collapsing the bag 60 and forcing fresh oil out of the container 61. Likewise, the bag 60 could be initially crushed, and as the used oil is introduced, the bag 60 expands, displacing the fresh oil. In addition, the oil adapter 70 can be integrated with the container 61 such that used oil flows from the engine to the outside annulus, crushing a bag 60 of fresh oil, which flows thru the center of the adapter 70 back to the engine.

Figure 2:
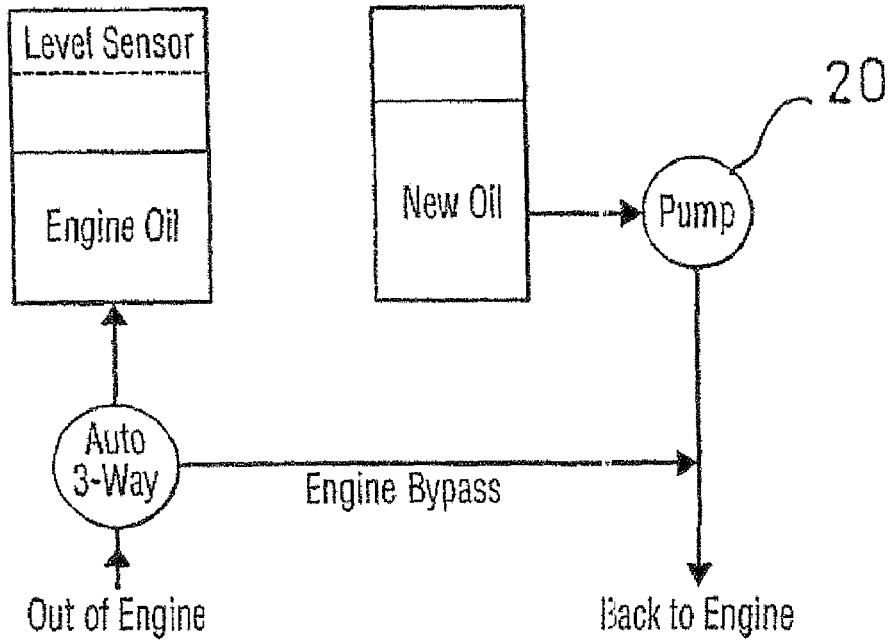
FIG. 2 is a schematic showing a piping and reservoir system wherein used oil is forced out of the engine into one reservoir and new oil is pumped from another reservoir back into the engine.

In another preferred embodiment, as depicted in FIG. 2, an external feed pump 20 is utilized with the engine running. Used oil is pumped past sensors (not shown), which measure the onset of oil flow and calculates total oil flow. This information is passed on to a controller (not shown), which controls an external feed pump. This allows the rate and amount of fresh oil introduction to be different from the rate and amount of used oil extraction.

All above devices will have safety features to ensure proper oil flow in the event all fresh oil is exhausted in the reservoir but the engine is still running. In addition, for engines with multiple oil filters in parallel plumbing, a blocking plate can be installed on other filters.

Installation of the quick change apparatus on a vehicle reduces oil change times (on the same cold ISB engine, the oil exchange time using a prototype internal piston was 3 minutes). The present invention also negates the need to crawl underneath the vehicle and reduces environmental concerns of oil spillage. It does not require any modification to the engine.

The external feed pump device, with the aid of a database and a microprocessor, can automatically determine proper fill quantities based on engine, VIN, or any unique identifier, which eliminates the need for top-offs. It also has the capability to minimize fresh and used oil mixing in the oil sump.

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein. Reference to documents made in the specification is intended to result in such patents or literature cited are expressly incorporated herein by reference, including any patents or other literature references cited within such documents as if fully set forth in this specification. The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

The invention claimed is:

1. A method of changing oil in a combustion engine that has an externally exposed oil filter comprising:

removing an oil filter attached to a mount on said engine;

said mount having an oil outlet and an oil inlet;

attaching an adapter to said mount said adapter having an outlet port coupled to the oil outlet, and an inlet port coupled to the oil inlet of the mount;

said outlet port coupled to a receiving reservoir;

said inlet port coupled to a sending reservoir containing fresh oil;

turning on the engine so that it pumps used oil through the outlet port into the receiving reservoir;

pumping fresh oil from the sending reservoir through the inlet port into the engine.

2. The method of claim 1 further comprising:

delaying the pumping of fresh oil into the engine until substantially all of the oil is pumped out of the engine to minimize the amount of old oil that is mixed with the fresh oil entering the engine.

3. The method of claim 1 further comprising:

controlling the flow rate of the fresh oil so that the flow rate of fresh oil is different than the flow rate of the used oil.

4. A method of changing oil in a combustion engine that has an externally exposed oil filter comprising:

removing the oil filter from an oil filter mount and installing an oil filter adapter having an outlet port and an inlet port to said oil filter mount;

wherein said outlet port is fluidly coupled to a reservoir device, said reservoir device having a moveable piston separating the reservoir device into a receiving region on a first side and a sending region containing fresh oil on a second side, wherein the outlet port is fluidly coupled to the first side;

fluidly coupling the inlet port to the sending region;

turning on the engine so that the engine pumps used oil through the outlet port to be retained in the receiving region and displacing the moveable piston so that it applies pressure to the fresh oil forcing the fresh oil through the inlet port into the engine;

turning off the engine; and removing the adapter and installing an oil filter in its place.

5. The method of claim 4 wherein the reservoir device is a cylinder.

6. The method of claim 4 further comprising:

delaying displacing the moveable piston until substantially all of the oil is pumped out of the engine to minimize the amount of old oil that is mixed with the fresh oil entering the engine.

7. The method of claim 4 further comprising:

controlling the flow rate of the fresh oil so that is different than the flow rate of the used oil.

8. The method of changing oil on an internal combustion engine having an oil filter mounted on an oil filter mount said mount having an oil inlet and an oil outlet, first removing said oil filter;

then turning said engine on thereby causing an oil pump to force existing oil through said oil outlet;

collecting said oil from said outlet;

providing fresh oil;

pumping fresh oil into said inlet to replace existing oil.

9. The method claimed in claim 8 wherein said existing oil that has been forced through the said oil outlet forces said fresh oil into said engine.

10. The method claimed in claim 8 further comprising:

delaying pumping new oil into said engine until most of said exiting oil is forced through said outlet.

* * * * *